US008123030B2

(12) United States Patent
Hein

(10) Patent No.: US 8,123,030 B2
(45) Date of Patent: Feb. 28, 2012

(54) CIGARETTE PACK AND PROCESS AND DEVICE FOR PRODUCING IT

(75) Inventor: Viktor Hein, Luttum (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 13/054,102

(22) PCT Filed: Jul. 11, 2009

(86) PCT No.: PCT/EP2009/005055

§ 371 (c)(1),
(2), (4) Date: Jan. 14, 2011

(87) PCT Pub. No.: WO2010/012370

PCT Pub. Date: Feb. 4, 2010

(65) Prior Publication Data

US 2011/0114518 A1 May 19, 2011

(30) Foreign Application Priority Data

Jul. 30, 2008 (DE) ..... 10 2008 035 467

(51) Int. Cl.
*B65D 85/10* (2006.01)

(52) U.S. Cl. ..... 206/273

(58) Field of Classification Search ..... 206/264, 206/271, 273; 229/87.13
See application file for complete search history.

(56) References Cited

U.S. PATENT DOCUMENTS

| | | | | |
|---|---|---|---|---|
| 4,300,676 | A * | 11/1981 | Focke et al. | 206/264 |
| 6,164,444 | A | 12/2000 | Bray et al. | |
| 6,199,687 | B1 * | 3/2001 | Tambo et al. | 206/268 |
| 6,370,846 | B1 | 4/2002 | Schoch et al. | |
| 6,478,149 | B1 * | 11/2002 | Parker | 206/273 |
| 7,353,940 | B2 * | 4/2008 | Sendo | 206/268 |
| 2007/0101683 | A1 | 5/2007 | Bray et al. | |

* cited by examiner

*Primary Examiner* — Jacob K Ackun
(74) *Attorney, Agent, or Firm* — Laurence P. Colton; Smith Risley Tempel Santos LLC

(57) ABSTRACT

An aroma-tight or moisture-tight pack for cigarettes (10) having an inner pack (12), produced from cardboard or a comparable packaging material, made tight as a result of corresponding treatment, and an outer pack (13) in the form of a hinge-lid box, however without a collar. A cigarette group (11) is positioned directly, that is without an inner envelope, in the inner pack (12). The inner pack is provided in an upper region, namely in the region of a cover (15) of the outer pack (13), with a particular opening aid. A closure tab (39) of the inner pack (12) is covered over its entire surface area by an actuating tab (42) which is realized as tape and is produced from a separate blank.

9 Claims, 5 Drawing Sheets

CIGARETTE PACK AND PROCESS AND DEVICE FOR PRODUCING IT

BACKGROUND OF THE INVENTION

1. Technical Field

The invention relates to a pack made of (thin) cardboard or similar-type packaging material, having an inner pack for the pack contents, in particular a cigarette group, and having an outer pack preferably in the form of a hinge-lid box, wherein the inner pack enveloping the pack contents has a closure tab in the region of an end removal opening, which is covered by an actuating tab provided with (permanent) adhesive and forming a protruding closure edge.

2. Prior Art

A cigarette pack with the abovementioned features is known in European Patent No. EP 1 037 822. The cigarette group, in the case of said known pack, is surrounded by a silver foil inner envelope folded in a cupular manner in such a way that the cigarettes for instance half protrude out of the cup. An inner pack is realized essentially as a hinge-lid box/pack having a closure tab defined by punched lines for a removal opening located in the end region. The inner pack realized in this manner is surrounded on all sides by a foil of impermeable material. Fold tabs of said foil are interconnected by means of thermal sealing. An actuating tab formed as part of said sealing foil is connected to the closure tab of the inner pack by means of gumming. When the actuating tab is gripped, said actuating tab is moved together with the closure tab of the inner pack into an open position. The multi-part pack realized in this manner is arranged in a separate outer pack which is realized in a classic manner as a hinge-lid box. Said known pack is material-intensive, has a complicated structure and is not able to be produced using efficient packaging machines.

BRIEF SUMMARY OF THE INVENTION

The object underlying the invention is to develop further a (cigarette) pack of the aforementioned type to the effect that the tightness of the pack as regards losses in aroma and moisture is maintained, however the expenditure on material is reduced and production is possible on efficient packaging machines.

To achieve this object the pack according to the invention is characterized by the following features:

a) the inner pack consists of thin cardboard or similar packaging material or of rigid, moisture-tight or aroma-tight material, in particular (thin) cardboard with an impermeable coating, b) the inner pack is directly surrounded by the outer pack, and c) the actuating tab is realized as a separate blank and is glued to the inner pack or to the blank of the inner pack over its entire surface area in the region of the closure tab thus forming a connecting edge running all around.

Accordingly the pack according to the invention essentially consists of two blanks or part packs, in each case produced from thin cardboard. The tightness of the pack is ensured through the corresponding embodiment of the material of the inner pack. Said inner pack preferably surrounds the cigarette group directly, that is without any further inner envelope. The closure tab of the inner pack is realized and arranged such that in the open position a removal opening is created like in the case of a collar of a conventional hinge-lid box. The actuating tab realized as tape is provided with a permanent adhesive over its entire surface area and is connected to the inner pack covering the closure tab. In an expedient manner, a unit produced from the blank of the inner pack with a correctly positioned tape is presented to the packaging machine or to a second packer as a prefabricated unit.

The blanks of the outer pack, on the one hand, and of the inner pack, on the other hand, are realized such that both part packs are able to be produced by applying the process usual for hinge-lid boxes. In particular, two packaging machines are used accordingly in an interacting manner and in a simplified design which correspond to a packer for hinge-lid boxes. A first packer is used to produce the inner packs, including pack contents. The second packer is used to produce the outer pack as classic hinge-lid boxes with the inner pack as contents.

BRIEF DESCRIPTION OF THE DRAWINGS

Further features and characteristics of the pack, of the production process and of the device are explained below by way of the drawings, in which.

DETAILED DESCRIPTION OF PREFERRED EMBODIMENTS

Figure 3:
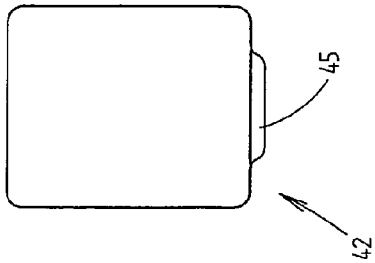
FIG. 3 shows a detail of the inner pack, namely an actuating tab or a closure tape.
Figure 4:
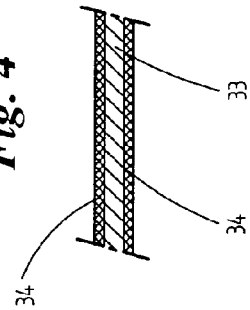
FIG. 4 shows a transverse section through packaging material on an enlarged scale.

The present pack is used to accommodate cigarettes 10 as pack contents. A cigarette group 11 formed from a plurality of cigarettes 10 arranged in formation fills out the interior of a part pack, namely an inner pack 12. Said inner pack is realized as a sealed pack. The cigarettes 10 are preferably without any additional inner envelope that is arranged directly in the inner pack 12. The cuboid inner pack 12, in its turn, is the contents of an outer pack 13, in this case in the form of a classic hinge-lid box or pack, here however without a collar. Outer pack 13 and inner pack 12 are provided with closure means which can be actuated independently of each other in order to obtain access to the pack contents.

The outer pack 13 in the form of a hinge-lid box is produced in a known manner from a (lower) box part 14 and a cover 15. Said cover is connected in one piece to the box part 14 by means of a crosswise linear hinged joint 16. The box part 14, according to the blank in FIG. 1, comprises box front wall 17, bottom wall 18 and box rear wall 19. Outside side tabs 20 are attached on both sides of the box front wall 17 and inside side tabs 21 are attached to the box rear wall 19. Together said tabs form box side walls 22, namely on account of overlapping and interconnection.

The cover 15 comprises cover rear wall 23 connected to the box rear wall 19, top end wall 24 and cover front wall 25. Cover side tabs 26 and 27 are arranged at the side of cover rear wall 23 and cover front wall 25 to form cover side walls 28. A cover inside tab 29 connects to a free edge of the cover front wall 25, said cover inside tab being folded towards the inside of the cover front wall 25 and being connected thereto (glue spots 30). Corner tabs, namely bottom corner tabs 31 and cover corner tabs 32 are arranged on the (inner) side tabs 21 and in a corresponding manner on the (inner) cover side tabs 26. Said corner tabs are foldable towards the inside of bottom wall 18 and end wall 24. The blank realized in this manner (FIG. 1) is produced from (thin) cardboard or similar-type packaging material with increased stability of form.

The inner pack 12 and its blank (FIG. 2) are realized in a particular manner such that preferably an extensively closed, aroma-tight and moisture-tight envelope is created. For this purpose, the blank (FIG. 2) is produced from (thin) cardboard 33, however in this case with a coating 34 on one side or on both sides. The coating 34 is realized such that the packaging material overall becomes moisture-tight or aroma-tight. The coating is produced, in particular, from plastics material and/or a layer of varnish and/or a metal or metallized layer.

The inner pack 12 forms a closed, cuboid container for the cigarette group 11. A removal opening 35 is formed for the removal of the pack contents, said removal opening extending in the region of an inside front wall 36 and at least in the region of an adjacent inside end wall 37. In the case of the present exemplary embodiment, the removal opening 35 extends in an upper region of the inside front wall 36, over the full depth (transverse dimension) of the inside end wall 37 and by way of an end region within an adjacent inside rear wall 38.

The removal opening 35 is closed before the first-time opening of the inner pack 12 and in the closed position by a closure tab 39, which is formed by means of punching as part of the blank of the inner pack 12, namely as a tongue of material that is connected to the blank in the region of the inside rear wall 38 by means of a linear hinged joint 40. The closure tab 39 is also defined by a U-shaped punched line 41 that at the same time determines the contour of the removal opening 35.

The removal opening 35 and the closure tab 39 filling out said removal opening are covered by an actuating member that can be used in a multiple manner, namely by an actuating tab 42 realized in the form of tape. Said actuating tab is produced from a foil and on the side facing the closure tab 39 is preferably provided over its entire surface area with a (permanent) adhesive. The actuating tab 42 realized as an individual blank (FIG. 3) has a somewhat rectangular contour and is dimensioned such that the closure tab 39 and consequently the removal opening 35 is completely covered over in the closed position, forming a protrusion or a connecting edge 43, which preferably extends all around and, in the closed position on account of the effect of the adhesive, abuts against a region of the inner pack 12 surrounding the removal opening 35. A crosswise end strip 44 is permanently connected to the inner pack 12, that is also during the opening and closing movements of the actuating tab 42, namely to the inside rear wall 38. Lying opposite, namely in the region of the inside front wall 36, the actuating tab 42 is provided with a grippable, glue-free grip tab 45.

The blank (FIG. 2) for the inner pack 12 is realized in a particular manner. The inside rear wall 38 extends continuously over the full dimension or height of the inner pack 12. The inside front wall 36 is divided—approximately in the center. A first, upper part wall 46 is connected to the inside end wall 37. A further (lower) part wall 47 connects to an inside bottom wall 48. In the case of the finished inner pack 12, the part walls 46, 47 meet in the region of a crosswise parting line 49 thus forming the inside front wall 36.

To form inside side walls 50, the blank of the inner pack 12 has side tabs which overlap each other and are interconnected by means of adhesion. The inside rear wall 38 is provided with integral rear side tabs 51 that continue over the full height. Outside side tabs of the inside front wall 36 are also divided in the region of the inside side walls 50, consequently forming part side tabs 52, 53 which, with the inner pack 12 folded, form the outside of the side walls 50 continuing the parting line 49. The continuous inside rear side tabs 51 ensure the stability of the inner pack 12.

Corner tabs are arranged on the rear side tabs 51, namely inside bottom corner tabs 54 abutting against the inside of the inside bottom wall 48. End corner tabs 55 are realized in a particular manner, namely as narrow material strips. The end corner tabs 55 abut against the inside of the inside end wall 37 and are connected in the region of edge webs 56 of the inside end wall 37 in the proximity of the removal opening 35, in particular by means of adhesion, in this case each time by means of two glue spots 57. The edge webs 56 as a boundary of the removal opening 35 are strengthened thereby. Over and above this, the tightness of the inner pack 12 is produced in this region.

Figure 7:
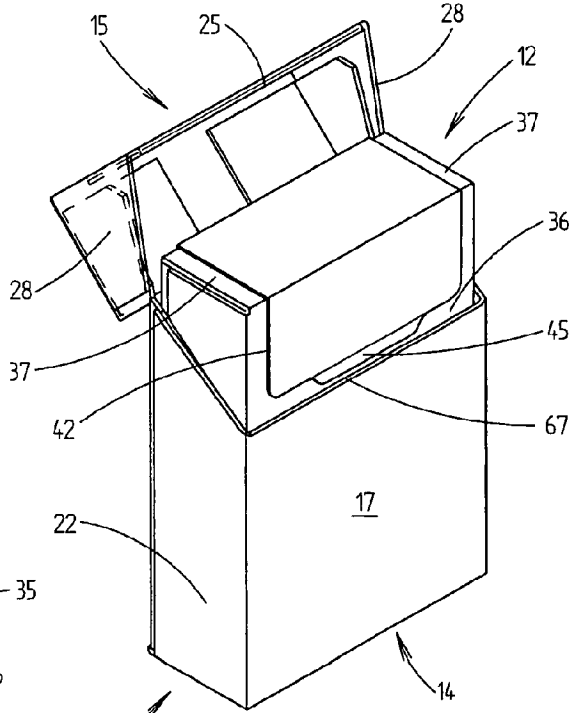
FIG. 7 shows a first step in the operation to open the pack in FIG. 6, namely the opened outer pack.
Figure 8:
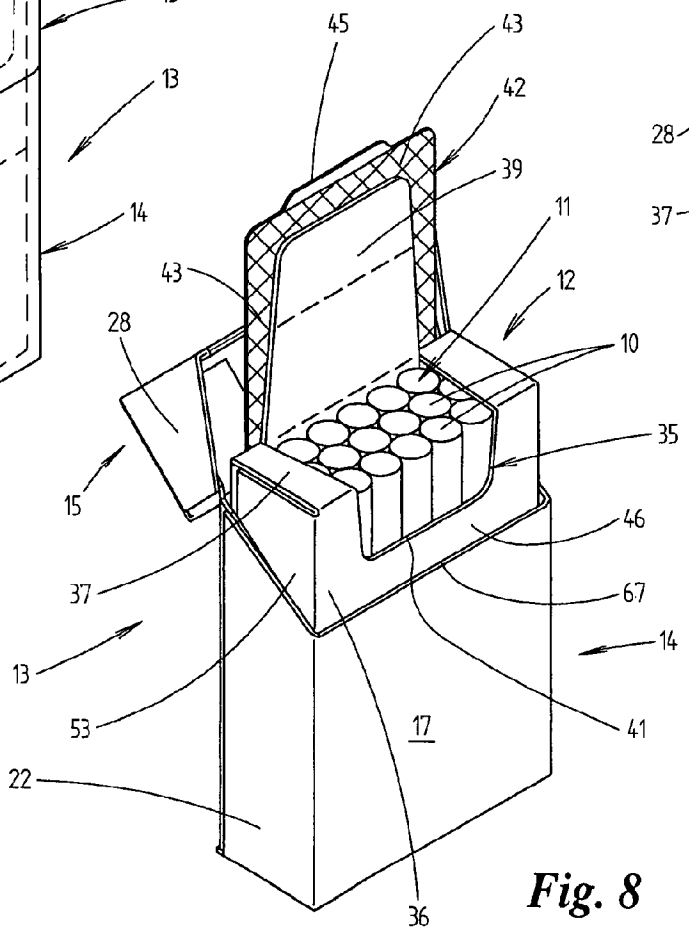
FIG. 8 shows the open pack, that is including the opened inner pack.
Figure 6:
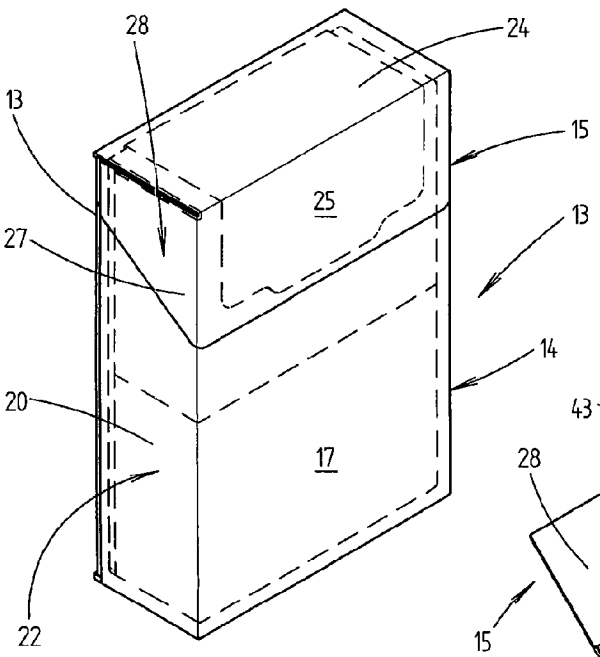

The inner pack 12 completely fills out the outer pack 13. The removal opening 35 is positioned such that, with the cover 15 of the outer pack 13 open, the removal opening 35 is freely accessible (FIG. 8). The dimensions are selected such that the actuating tab 42 is also completely exposed when the cover 15 is in the open position (FIG. 7). The grip tab 45 is grippable at the front. By raising the actuating tab 42 and releasing the glue connection to the region of the inner pack 12 in the proximity of the removal opening 35, the closure tab 39 is also raised into the open position. The inner pack 12 can be closed again by means of the reverse movement. The external appearance of a typical hinge-lid box is created by closing the cover 15 (FIG. 6). The outer pack 13 is realized as a hinge-lid box without a collar. This means that the removal opening 35 of the inner pack 12 in the region of the front side can be dimensioned such that in relation to an upper boundary of the box front wall 17, namely an upper (edge) border 67, only a relatively narrow strip of the inside front wall 36 remains exposed for the abutment of the actuating tab 42 with grip tab 45. Said grip tab extends directly above the border 67.

Inner pack 12 and outer pack 13 are matched to one another such that the parting line 49 of the inner pack 12 is clearly situated in the region of the box front wall 17 of the outer pack 13 (FIG. 6). The part walls 46, 47 are connected to the inside of the box front wall 17 by means of adhesion at least in this region. Glue places or glue spots 66 are arranged such that the regions adjacent to the parting line 49 are connected to the outer pack 13 creating a certain tightness. The glue regions are arranged such that the parting line 49 remains free of glue.

The actuating tab 42 can be arranged and/or realized such that the grip tab 45 rests in the region of the top border 67 (closing edge) of the box part front wall 17 and covers said edge by abutting against the outside of the box front wall 17. This means that the grip tab 45 can be easily gripped.

The pack overall accordingly comprises two blanks (FIG. 1, FIG. 2) and the separate blank of the actuating tab 42. As an alternative to this, a further blank can be used, namely an inner blank made of paper or silver foil for the (complete) enveloping of the cigarette group 11.

Figure 2:
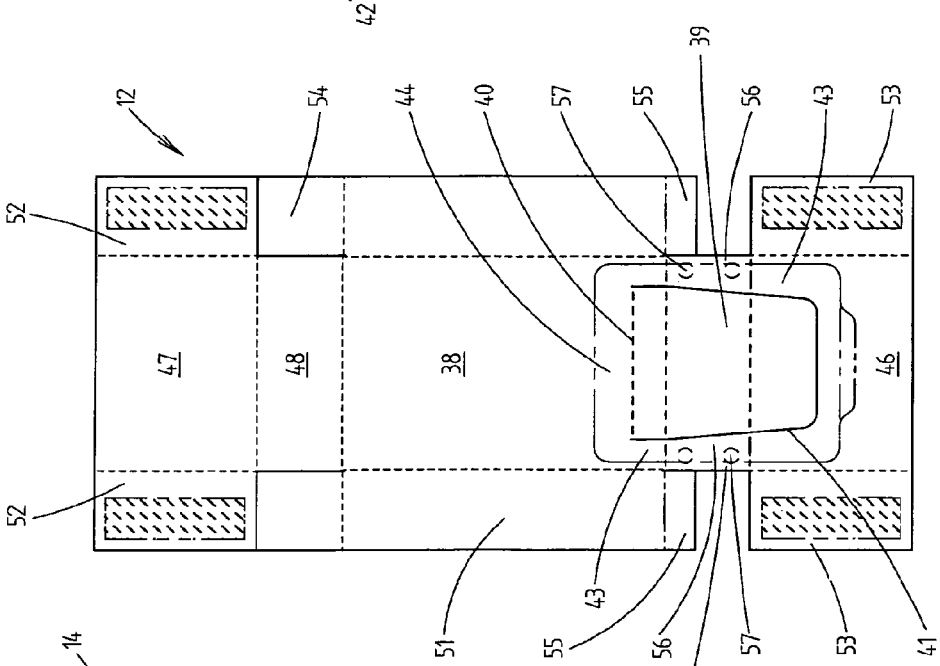
FIG. 2 shows a blank for an inner pack.
Figure 1:
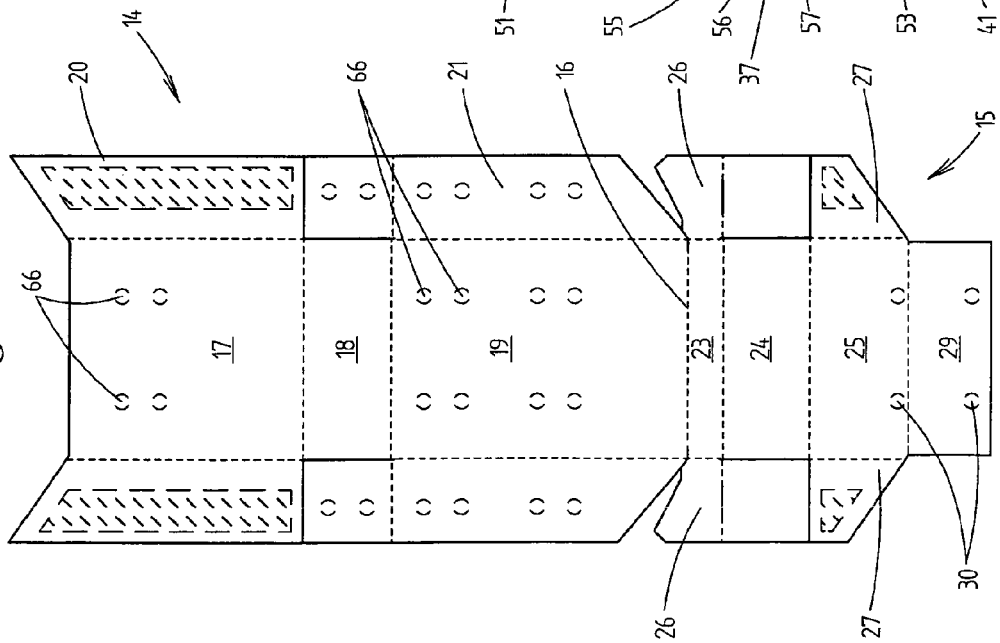
FIG. 1 shows a blank for an outer pack.
Figure 10:
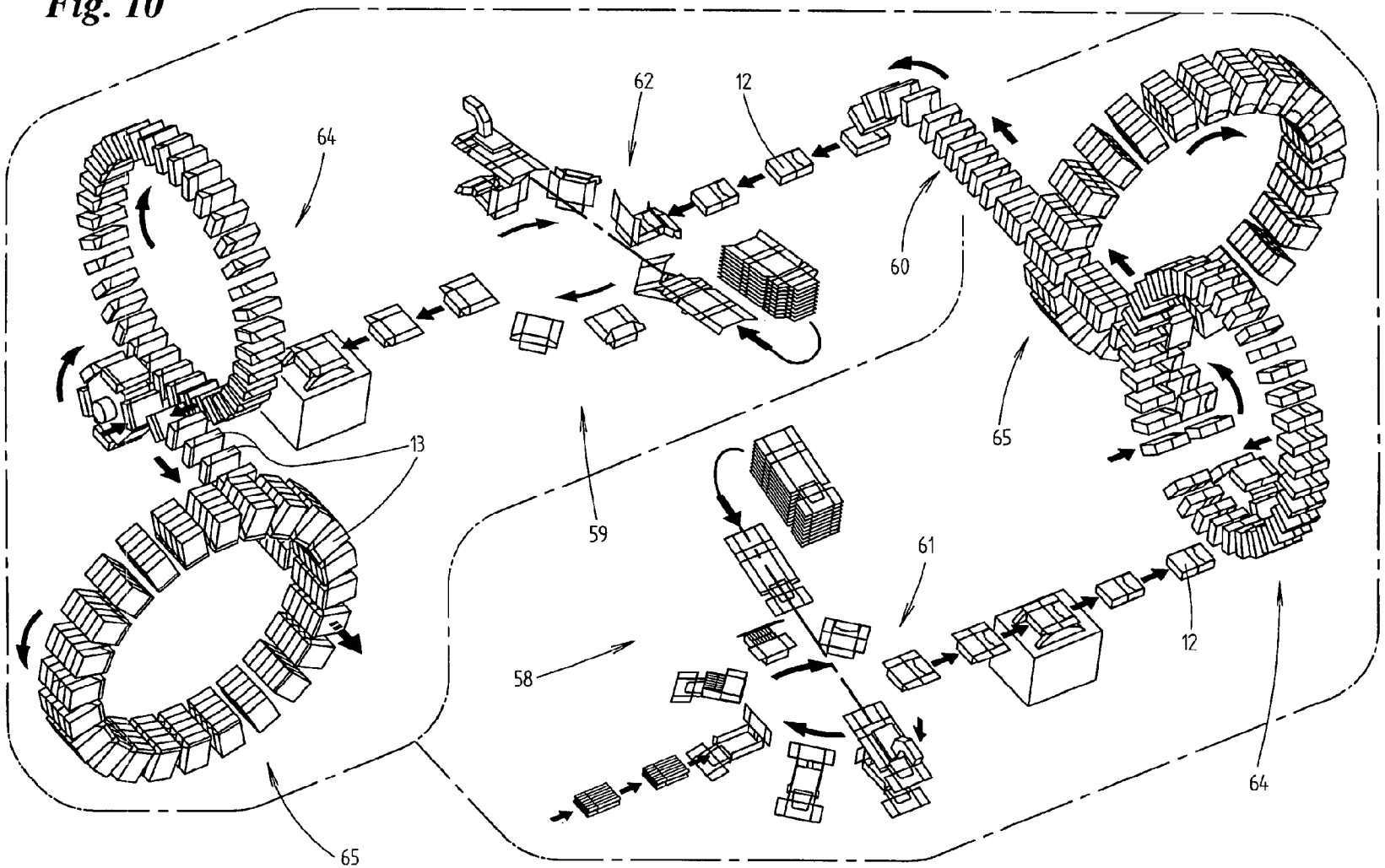
FIG. 10 shows a perspective flow diagram of the production of packs in FIG. 1 to FIG. 8.
Figure 11:
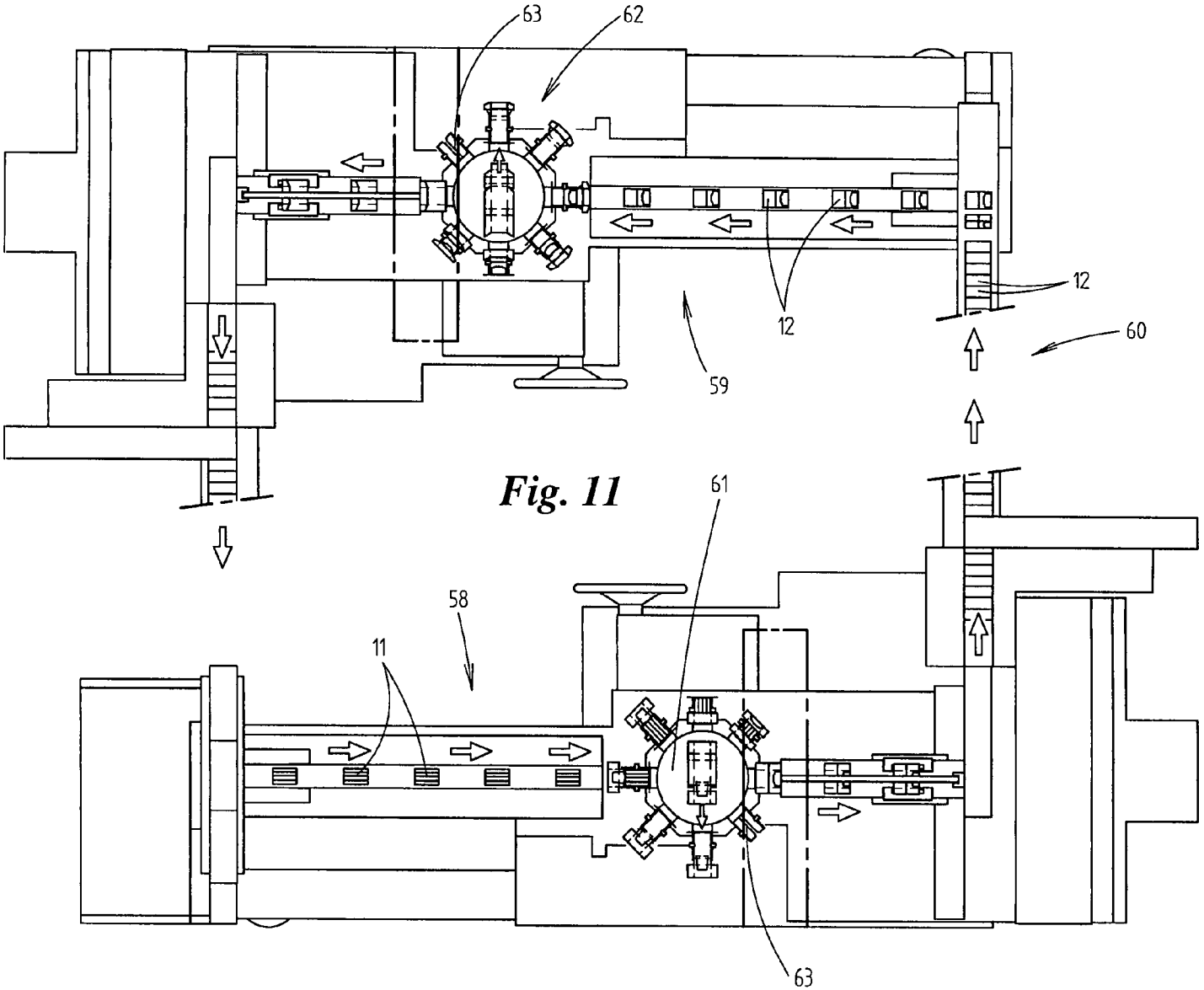
FIG. 11 shows a schematic top view of a system with two packaging machines.

The embodiment of the blanks in FIG. 1 and FIG. 2 makes it possible to produce the complete pack by applying folding and filling steps that are usual in the case of standard hinge-lid boxes. The inner pack 12 and the outer pack 13 are produced by separate packaging machines. As shown in FIG. 10 and FIG. 11, a first packaging machine 58 is used to produce the inner pack 12 and a second packaging machine 59 to produce the complete pack by inserting the inner pack 12 in each case into an outer pack 13. The machines 58, 59 are arranged next to each other in parallel alignment and are interconnected by means of a transfer section 60. The (complete) inner packs 12 produced by the packaging machine 58 are conveyed to the input side of the packaging machine 59 by means of the crosswise transfer section 60 and are processed as pack contents for the outer pack 13.

Figure 9:
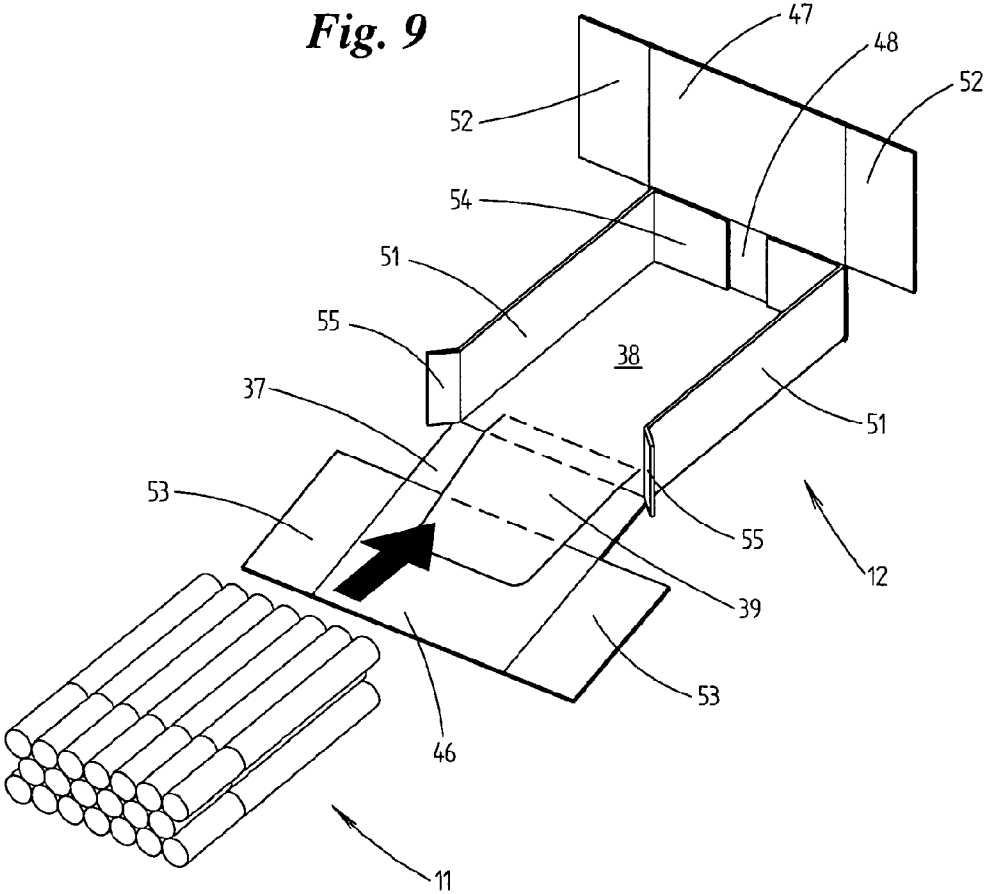
FIG. 9 shows a perspective representation of an intermediate fold position of a blank of the inner pack whilst a cigarette group is being inserted.
Figure 5:
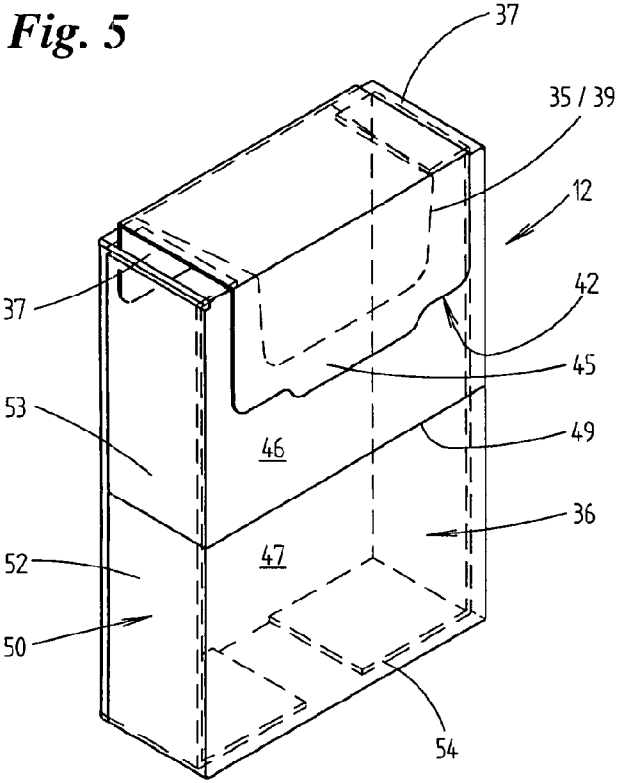
FIG. 5 shows a perspective representation of a finished, closed inner pack, FIG. 6 also shows a perspective representation of a complete pack with inner pack and outer pack.

The two packaging machines 58, 59 are provided with a fold turret 61, 62 which corresponds in an extensive manner to a conventional fold turret on a packaging machine for hinge-lid boxes, namely is rotatable about a vertical axis and has radially directed pockets 63 for accommodating in each case a blank for the inner pack 12 or outer pack 13. When being inserted into a pocket 63, the blanks are folded into an angular-shaped intermediate fold position (FIG. 9). This is selected for the blank of the inner pack 12 such that the inside rear wall 38 is aligned in a horizontal plane, just as the inside end wall 37 with connecting part wall 46 and part side tabs 53. The rear side tabs 51, that is the inside side tabs arranged on the inside rear wall 38, are folded into the upright position. The inside bottom wall 48 with part wall 47 and part side tabs 52 forms an upright fold portion. The inside bottom corner tabs 54 are also set upright in said first fold step and are folded towards the inside of the inside bottom wall 48.

The pack contents, namely a formed cigarette group 11, can then be inserted via the open side, that is via the region of the inside end wall 37, into the partially folded inner pack 12. As the fold turret 61 rotates further, the region of the bottom-side part wall 47 is initially folded towards the top side of the cigarette group 11. The inside end wall 37 is then set upright and the part wall 46 is also folded towards the cigarette group 11. Finally, the side tabs 52, 53 are folded into an upright position.

The inner pack 12 produced in this manner is supplied to a first shaping drying turret 64 and then to a second drying turret 65. The finished, dimensionally stable inner packs 12 then pass via the transfer section 60 to the input side of the packaging machine 59.

The packaging machine 59 is expediently realized like a standard packaging machine for hinge-lid boxes, with the difference that the inner pack 12 takes the place of a cigarette block with a collar.

A further simplification of the production process can be that finished blanks as in FIG. 2 with an actuating tab 42 attached in the correct position are supplied to the packaging machine 58, where applicable it being possible for a unit for attaching the actuating tabs 42 onto the unfolded blanks of the inner pack 12 to be mounted in the region of a blank path for supplying the blanks to the fold turret. The outer pack 13 is provided on the inside with glue, in this case with glue spots 66 for fixing the inner pack 12 in the outer pack 13 or in the box part 14 of the same.

LIST OF REFERENCES

10 Cigarette
11 Cigarette group
12 Inner pack
13 Outer pack
14 Box part
15 Cover
16 Linear hinged joint
17 Box front wall
18 Bottom wall
19 Box rear wall
20 Side tabs (outside)
21 Side tabs (inside)
22 Box side wall
23 Cover rear wall
24 End wall
25 Cover front wall
26 Cover side tab
27 Cover side tab
28 Cover side wall
29 Cover inside tab
30 Glue spot
31 Bottom corner tab
32 Cover corner tab
33 Cardboard
34 Coating
35 Removal opening
36 Inside front wall
37 Inside end wall
38 Inside rear wall
39 Closure tab
40 Linear hinged joint
41 Punched line
42 Actuating tab
43 (Connecting) edge strip
44 End strip
45 Grip tab
46 Part wall
47 Part wall
48 Inside bottom wall
49 Parting line
50 Inside side wall
51 Rear side tab
52 Part side tab
53 Part side tab
54 Inside bottom corner tab
55 End corner tab
56 Edge web
57 Glue spot
58 Packaging machine
59 Packaging machine
60 Transfer section
61 Fold turret
62 Fold turret
63 Pocket
64 Drying turret
65 Drying turret
66 Glue spot
67 Border/edge

The invention claimed is:

1. A pack made of thin cardboard or similar-type packaging material comprising:

an inner pack (12) for the pack contents, the pack contents being a cigarette group (11), wherein the inner pack (12) envelopes the pack contents and the inner pack comprises a closure tab (39) in the region of an end removal opening (35), which is covered by an actuating tab (42) provided with adhesive and forming a protruding closure edge or edge strip (43); and an outer pack (13) in the form of a hinge-lid box, wherein:

a) the inner pack (12) is produced from the thin cardboard or similar packaging material, or from aroma-tight or moisture-tight material, or from thin cardboard with a coating of impermeable material, b) the inner pack (12) is directly surrounded by the outer pack (13), c) the actuating tab (42) is a separate blank tape and is attached directly to the inner pack (12) in the region of the removal opening (35), d) the inner pack (12) comprises an inside front wall (36) that comprises two part walls (46, 47), which together form the inside front wall (36) and which meet each other along a crosswise parting line (49), and e) the parting line (49) for defining the part walls (46, 47) of the inner pack (12) is located within the outer pack (13) and below a top closure edge (67) of the outer pack (13) formed by a box part front wall (17).

2. The pack as claimed in claim 1, wherein the outer pack (13) is a hinge-lid box comprising a box part (14) and a cover (15), without a collar.

3. The pack as claimed in claim 1, further comprising an inner blank inner liner, wherein the cigarette group (11) is surrounded by the inner blank inner liner, which is made of silver foil or paper, thus forming a cigarette block that is arranged in the inner pack (12).

4. The pack as claimed in claim 1, wherein in an upper region of the inside front wall (36) of the inner pack (12) the removal opening (35) extends over the full depth of an inside end wall (37) of the inner pack (12) by way of a further part region in an inside rear wall (38) of the inner pack (12).

5. The pack as claimed in claim 2, wherein the removal opening (35) of the inner pack (12) extends in the region of the inside front wall (36) as far as above the box part (14) of the outer pack (13), namely at a spacing from the upper edge (67) of the box front wall (17) of the outer pack (13) in such a manner that the edge strip (43) of the actuating tab (42) and a grip tab (45) of the actuating tab (42) are located directly above the upper edge (67).

6. The pack as claimed in claim 1, wherein the two part walls (46, 47) of the inside front wall (36) of the inner pack (12) are approximately the same size as each other.

7. The pack as claimed in claim 6, wherein the part walls (46, 47) of the inside front wall (36) of the inner pack (12) are connected to the inside of the box front wall (17) of the outer pack (13) by means of adhesion, wherein glue regions are provided at a small spacing above and below the parting line (49) on the part walls (46, 47).

8. The pack as claimed in claim 6, wherein the inner pack (12) further comprises inside side walls (50) and outer side tabs, the outer side tabs being divided from the inside side walls (50) of the inner pack (12) thus forming part side tabs (52, 53), and inside rear side tabs (51) that are formed in one piece.

9. The pack as claimed in claim 1, wherein the actuating tab (42) has a glue-free grip tab (45) for gripping the actuating tab (42), wherein the grip tab (45) extends beyond the upper edge (67) formed by the box front wall (17) of the outer pack (13).

* * * * *